US007344366B2

(12) United States Patent
Kim

(10) Patent No.: US 7,344,366 B2
(45) Date of Patent: Mar. 18, 2008

(54) HERMETIC COMPRESSOR HAVING A HIGH PRESSURE CHAMBER

(75) Inventor: Kwang-Ho Kim, Kyungsangnam-Do (KR)

(73) Assignee: LG Electronics Inc., Seoul (KR)

( * ) Notice: Subject to any disclaimer, the term of this patent is extended or adjusted under 35 U.S.C. 154(b) by 430 days.

(21) Appl. No.: 10/496,137

(22) PCT Filed: Jun. 18, 2002

(86) PCT No.: PCT/KR02/01145

§ 371 (c)(1),
(2), (4) Date: May 20, 2004

(87) PCT Pub. No.: WO03/044373

PCT Pub. Date: May 30, 2003

(65) Prior Publication Data

US 2005/0002803 A1 Jan. 6, 2005

(30) Foreign Application Priority Data

Nov. 23, 2001 (KR) ..... 2001-73514

(51) Int. Cl.
*F04C 18/00* (2006.01)

(52) U.S. Cl. ..... 418/63

(58) Field of Classification Search ..... 417/410.3, 417/424.1; 418/151, 60, 63, 65
See application file for complete search history.

(56) References Cited

U.S. PATENT DOCUMENTS 5,152,682 A * 10/1992 Morozumi et al. ..... 418/55.1
5,597,293 A * 1/1997 Bushnell et al. ..... 417/410.3
5,842,846 A * 12/1998 Fukuoka et al. ..... 418/63

FOREIGN PATENT DOCUMENTS

| | | | |
|---|---|---|---|
| JP | 57-31593 | U | 2/1982 |
| JP | 2-136588 | A | 5/1990 |
| JP | 2-153289 | A | 6/1990 |
| JP | 6-193574 | A | 7/1994 |
| JP | 11-037065 | A | 2/1999 |
| KP | 10 0217121 | B1 | 9/2000 |

* cited by examiner

*Primary Examiner*—Anthony Stashick
*Assistant Examiner*—Vikansha Dwivedi
(74) *Attorney, Agent, or Firm*—Birch, Stewart, Kolasch & Birch, LLP

(57) ABSTRACT

A hermetic compressor is disclosed to reduce a production cost, for which low temperature and low pressure gas passes inside a case to reduce a pressure inside the case so that it is not necessary to increase the thickness of the case and to reinforce a strength. The hermetic compressor includes a case having a suction tube and a discharge tube; a driving unit installed at an upper side of the case and generating a driving force; and a compressing unit installed at a lower side of the case and connected to the driving unit by a rotational shaft so as to compress the low temperature and low pressure gas sucked into the case through the suction tube by a rotational force generated from the driving unit and discharge the gas through the discharge tube.

13 Claims, 5 Drawing Sheets

HERMETIC COMPRESSOR HAVING A HIGH PRESSURE CHAMBER

TECHNICAL FIELD

The present invention relates to a hermetic compressor and particularly, to a hermetic compressor, capable of improving compression performance of gas and reducing noise.

BACKGROUND ART

Generally, a compressor can be formed by various types according to compressing methods, and as an air conditioning apparatus which is required to be smaller and lighter, a hermetic rotary compressor is mainly used.

FIG. 1 is a transverse sectional view showing a hermetic compressor in accordance with the conventional art, and FIG. 2 is a longitudinal sectional view showing a compressing unit of the hermetic compressor in accordance with the conventional art.

A hermetic rotary compressor in accordance with the conventional art includes a case 106 having a hermetic space therein, which is connected with a suction tube 102 to which gas is sucked and a discharge tube 104 through which compressed gas is discharged, a driving unit 108 which is mounted at an upper portion of the case 106, for generating a driving force, a compressing unit 112 which is connected with the driving unit 108 with a rotational shaft 110, for compressing fluid by a rotational force generated in the driving unit 108.

The driving unit 108 includes a stator 114 which is fixed on the inner circumference of the case 106 and to which a power is applied from the outside, and a rotor 116 which is positioned on the inner circumference of the stator 114 at a predetermined interval from the stator 114, and rotates by interaction with the stator 114 when a power is applied to the stator 114.

The compressing unit 112 includes an eccentric portion 118 which is at a lower portion of the rotational shaft 110 fixed on the inner circumferential surface of the rotor 116, a cylinder 120 in which the eccentric portion 118 is inserted and gas is compressed and which is fixed on the case 106, upper and lower frames 122 and 124 which are combined with the upper and lower side of the cylinder 120 so as to seal the compressing space of the cylinder 120, for rotably supporting the rotational shaft 110, a piston 128 which is inserted in the circumferential surface of the eccentric portion 118 of the rotational shaft 110, for compressing fluid while revolving the compressing space 126 of the cylinder 120, and a vane 130 which is inserted at a side of the compressing space 126 of the cylinder in the radius direction so that it can perform linear movement and is linearly contacted on the outer circumferential surface of the piston 128, for dividing the compressing space 126 of the cylinder 120 into a suction region 126*a* and compressing region 126*b*.

A suction port 132 which is connected with the suction tube 102 to suck gas is formed on a side surface of the suction region 126*a* in the compressing space 126, and a discharge port 134 through which gas compressed in the compressing space 126 is discharged is formed on the upper surface of the compressing region 126*b*.

A discharge hole 136 which is connected with the discharge port 134 is formed in the upper frame 122, and discharges the gas discharged through the discharge port 134 in the upward direction of the case 106. In addition, a check valve 140 for preventing inverse flow of gas to the compressing space 126 is mounted on the upper surface of the discharge hole 136.

The vane 130 is inserted in an insertion hole 142 formed in the cylinder 120 so that it can perform linear movement, and a coil spring 144 is positioned between the vane 130 and the insertion hole 142 so as to be elastically abutted on the outer circumferential surface of the piston 128.

The suction tube 102 is connected with an accumulator 150 for preventing inflow of liquid refrigerant, and the accumulator 150 is connected with an evaporator which composes a freezing cycle.

The operation of the conventional hermetic compressor with the above structure will be described.

When a power is applied to the stator 114 of the driving unit 108, the rotor 116 rotates by interaction between the stator 114 and the rotor 116 and the rotational shaft 110 rotates together. Then, the eccentric portion 118 which is mounted at a lower end of the rotational shaft 110 rotates, and the rolling piston 128 which is mounted in the circumferential direction of the eccentric portion 118 revolves in the compression space under an eccentric condition.

At this time, the gas which flows to the suction tube 102 is sucked to the compression space 126 of the cylinder 120 through the suction port 132, and low temperature and low pressure gas is compressed to high temperature and high pressure gas by change of volume of the compressing space 126 caused by revolution of the rolling piston 128. Therefore, the high temperature and high pressure gas is discharged into the case 106 through the discharge port 134 and the discharge hole 136.

The high temperature and high pressure gas discharged into the case 106 flows through a space between the stator 114 and rotor 116 of the driving unit 108 and a space between inner walls of the stator 114 and rotor 116 and is discharged to the outside through the discharge tube 104.

However, in the above described conventional hermetic compressor, since gas is sucked to the compressing space of the cylinder through the suction tube, is compressed by revolution of the rolling piston, and is discharged to the discharge tube by passing the inside of the case, high temperature and high pressure gas passes the inside of the case, and accordingly, the case must be designed by considering different internal pressures according to the pressure of gas. Therefore, the thickness of the case becomes thicker and manufacturing cost is increased by reinforcing the strength of the case.

Also, since the high temperature and high pressure gas passes between the stator and rotor of the driving unit, temperature of the driving unit increases and performance of the driving unit is degraded.

Also, since the high temperature and high pressure gas causes pressure loss by increased flow resistance of the gas and passes the inside of the case, noise was increased by pressure pulsation caused by difference of internal volume of the case.

TECHNICAL GIST OF THE PRESENT INVENTION

Therefore, an object of the present invention is to provide a hermetic compressor, capable of reducing a production cost, for which low temperature and low pressure gas passes inside a case to reduce a pressure inside the case so that it is not necessary to increase the thickness of the case and to reinforce a strength.

Another object of the present invention is to providing a hermetic compressor, capable of improving efficiency of a driving unit by reducing temperature of the driving unit, for which low temperature and low pressure gas passes between the rotor and stator of the driving unit.

Still another object of the present invention is to providing a hermetic compressor, capable of reducing vibration according to compression pulsation generated in the case by directly discharging the compressed gas without passing the inside of the case.

DETAILED DESCRIPTION OF THE INVENTION

In order to achieve the above objects, there is provided a hermetic compressor, including a case having a hermetic space through which gas with low temperature and pressure being connected with a suction tube at a side and a discharge tube which is connected with the other side to discharge the compressed gas, a driving unit mounted at an upper side of the case, for generating a driving force and a compressing unit mounted at a lower side of the case and connected to the driving unit by a rotational shaft so as to compress the gas with low temperature and low pressure sucked into the case through the suction tube by a rotational force generated from the driving unit and discharge the gas through the discharge tube.

The compressing unit includes an eccentric ring which is fixed at a lower side of the rotational shaft, a cylinder in which the eccentric ring is rotably mounted, a compression space where gas is compressed is formed, a suction passage for guiding gas sucked into the case to the compression space is formed at a side of the compression space, a rolling piston which is fixed on the outer circumferential surface of the eccentric ring, for compressing gas while revolving in the compression space of the cylinder, an upper frame which is fixed on the upper side surface of the cylinder so that it can be sealed, for rotably supporting the rotational shaft and a lower frame which is fixed on the upper side surface of the cylinder so that it can be sealed, and in which a high pressure chamber through which gas compressed in the compressing space of the cylinder is temporarily stored and is discharged to the discharge tube.

The suction tube is positioned at an upper side of the compressing unit, and the discharge tube is positioned on a side surface of the compressing unit.

The suction tube is connected with an upper cover which is fixed at the upper side of the case so that the gas sucked into the case passes the driving unit and is supplied to the suction unit.

The cylinder is formed in a type of a circular disk having a predetermined thickness and is fixed on an inner circumferential surface of the case, a compressing space for compressing gas while revolving the rolling piston is formed at the center of the cylinder, and a suction passage which communicates with the compressing space in an upward direction, for flowing gas sucked through the suction tube to the compressing space.

A vane which performs a linear reciprocating movement in a radius direction of the compressing space in order to divide the compressing space into a suction region to which gas is sucked and a compressing region in which the sucked gas is compressed is installed on an inner circumferential surface of the cylinder.

The lower frame which is combined on a lower surface of the cylinder so that it can be sealed includes a through hole through which the rotational shaft rotably passes at the center of the frame, a high pressure chamber for reducing noise generated in gas discharged while gas compressed in the compressing space of the compressing space of the cylinder in the circumferential direction is temporarily stored and discharged, and a discharge passage for connecting the high pressure chamber and compressing space.

A check valve for preventing gas discharged from the compressing chamber from being inversely flow to the compressing chamber is mounted in the discharge passage of the lower frame.

A side of the check valve is fixed on an upper surface of the high pressure chamber and the other side is formed in a plate type having a predetermined elastic force to open and close the discharge passage.

A sealing plate for sealing the high pressure chamber is mounted on the lower surface of the lower frame.

The sealing plate is formed in a shape of a circular disk having a predetermined thickness, a through hole through which the rotational shaft passes is formed at the center of the sealing plate, and a sealing member for preventing gas from being leaked from the high pressure chamber is mounted in the inner and outer circumferential directions of the high pressure chamber.

The sealing member includes a first sealing member inserted in a first groove which is formed in a circumferential direction at a predetermined interval from the high pressure chamber inside the high pressure chamber and a second sealing member inserted in a second groove which is formed in a circumferential direction at a predetermined interval from the high pressure chamber in an outer circumferential direction of the high pressure chamber.

The first and second sealing members are formed with rubber materials of a ring type.

MODE FOR CARRYING OUT THE PREFERRED EMBODIMENTS

The present invention will now be described with reference to accompanying drawings.

Figure 1:
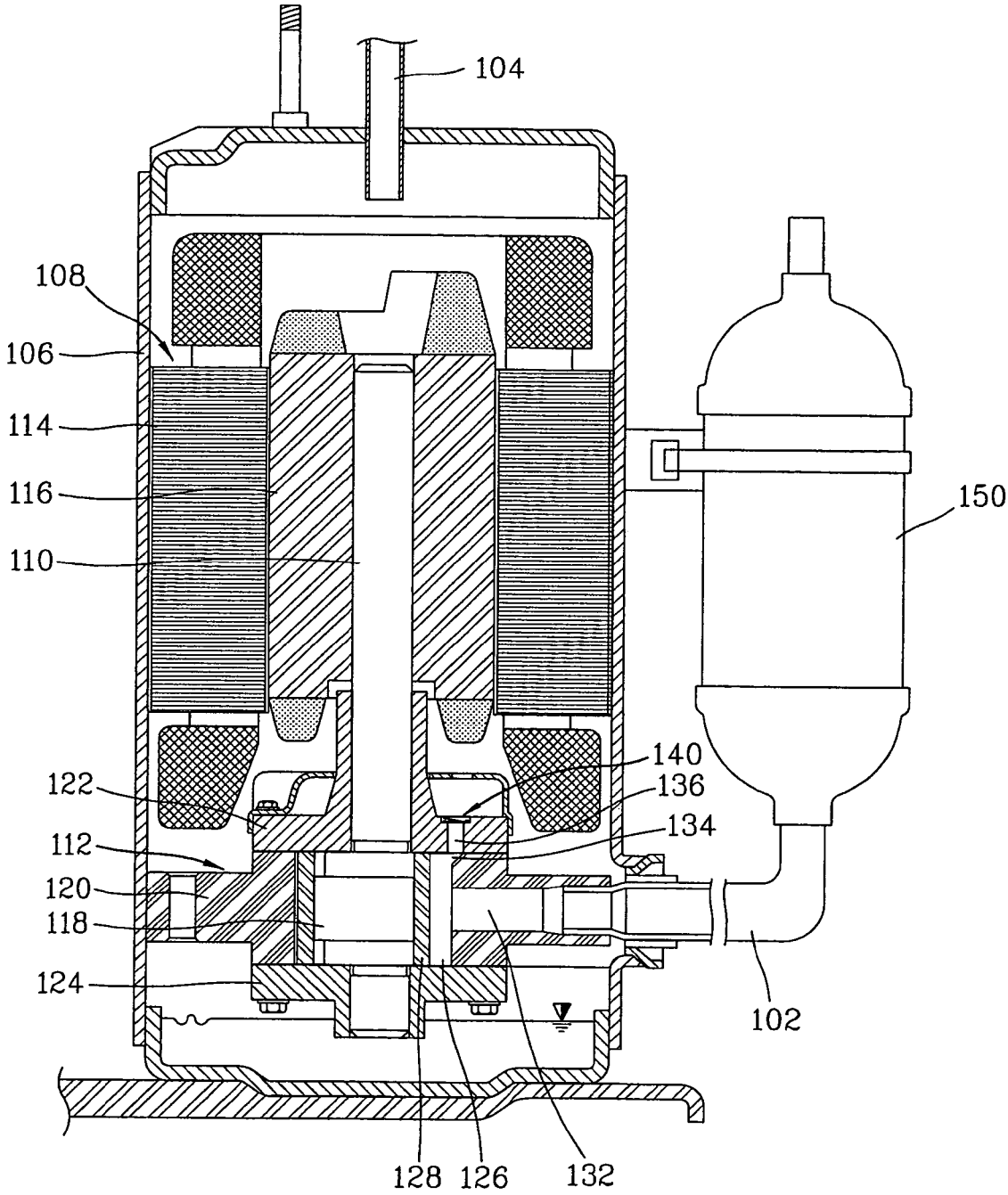
FIG. 1 BACKGROUND ART
FIG. 1 is a transverse sectional view showing a hermetic compressor in accordance with the conventional art.
Figure 2:
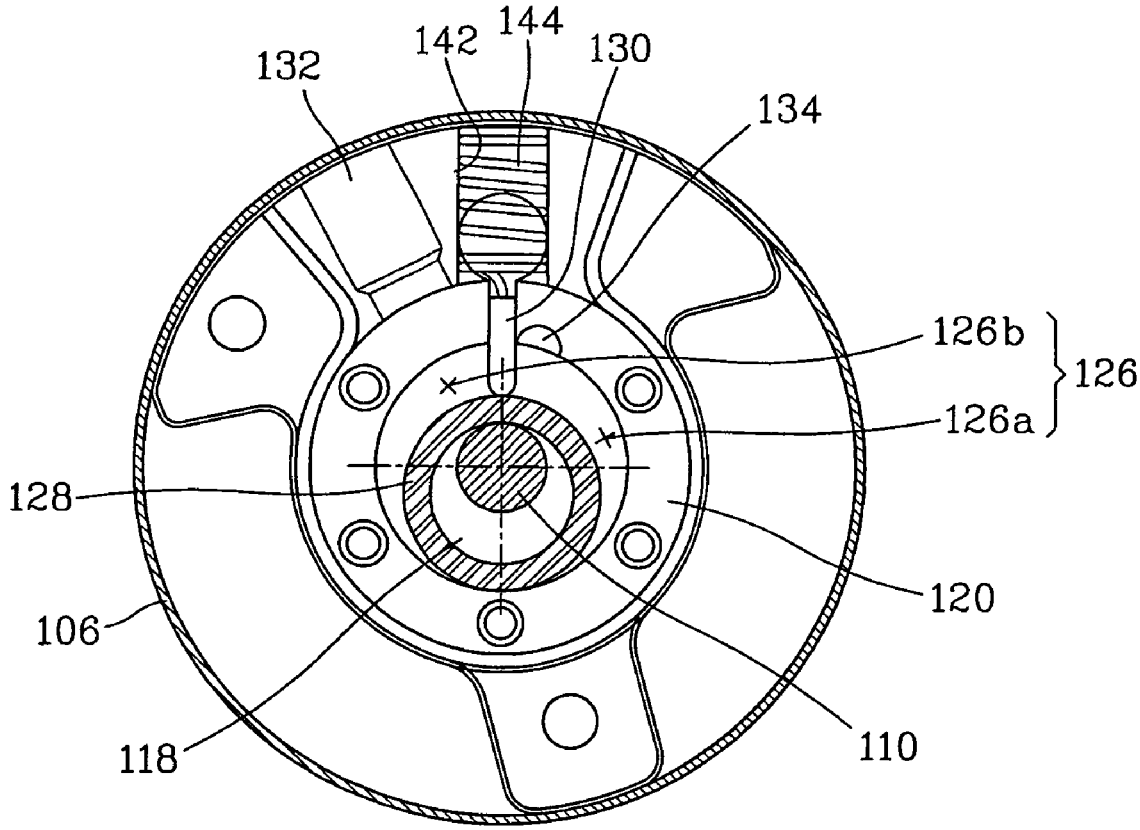
FIG. 2 BACKGROUND ART
FIG. 2 is a longitudinal sectional view showing a compressing unit of the hermetic compressor in accordance with the conventional art.
Figure 3:
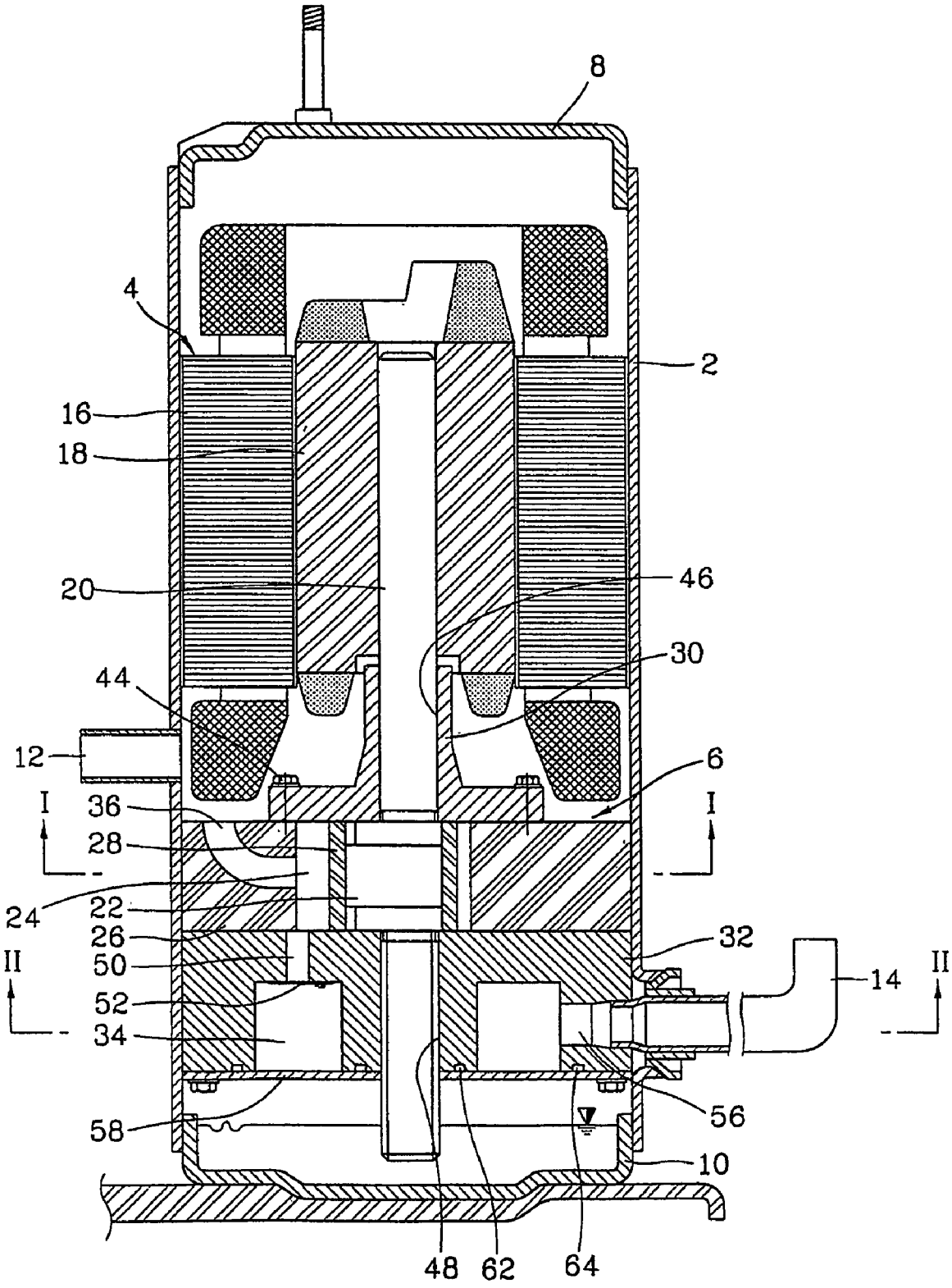
FIG. 3 is a transverse sectional view showing a hermetic compressor in accordance with an embodiment of the present invention.

FIG. 3 is a transverse sectional view showing a hermetic compressor in accordance with an embodiment of the present invention.

The hermetic compressor of the present invention includes a case 2 having a hermetic space, a driving unit 4 mounted at an upper side of the case 2, for generating a driving force and a compressing unit 6 mounted at a lower portion of the case 2, for compressing gas by a rotational force generated in the driving unit 4.

The case 2 is formed in a cylindrical shape by mounting the upper and lower covers 8 and 10 at the upper and lower sides. A suction tube 12 to which gas is sucked is connected at a side surface of the case 2 and a discharge tube 14 through which gas compressed passing through the compressing unit 6 is connected to the other side surface of the case 2. Here, the suction tube 12 is positioned at the upper side of the compressing unit 6 and the discharge tube 14 is positioned on a side surface of the compressing unit 6. That is, the suction tube 12 is connected relatively at an upper side of the case 2 than the discharge tube 14.

The driving unit 4 includes a stator 16 which is fixed on the upper inner circumferential surface of the case 2 and to which a power is supplied from the outside, and a rotor 18 which is positioned on the inner circumference of the stator 16 at a predetermined interval from the stator 16 and rotates by interaction with the stator 16 when the power is applied to the stator 16.

A rotational shaft 20 for transferring a rotational force of the driving unit 4 to the compressing unit 6 is fixed to the inner side of the rotor 18.

Figure 4:
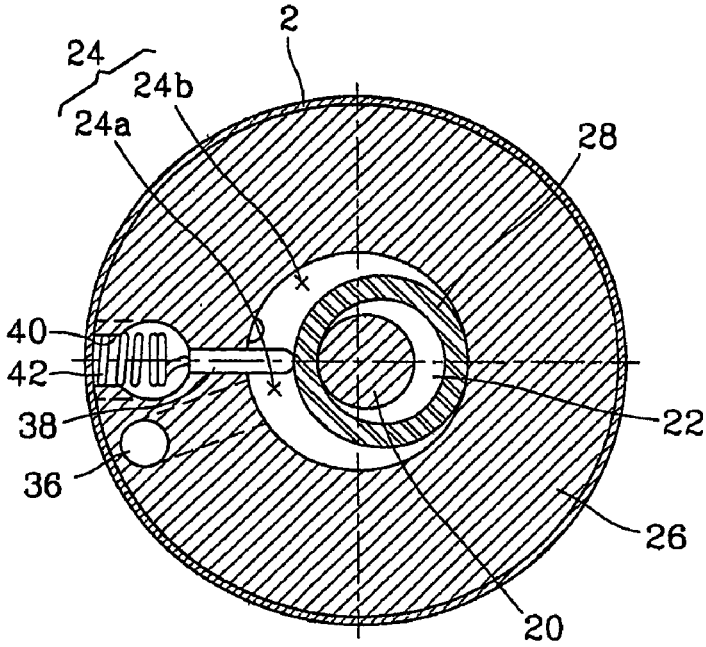
FIG. 4 is a cross-sectional view taken along section line I—I of FIG. 3 showing a compressing unit of the hermetic compressor of the present invention.

As shown in FIGS. 3 and 4, the compressing unit 6 includes an eccentric ring 22 which is fixed at a lower portion of the rotational shaft 20 under the condition that it is eccentrically formed to a predetermined degree, a cylinder 26 in which the eccentric ring 22 is rotably mounted and a compression space 24 where gas is compressed is formed, a rolling piston 28 which is fixed on the outer circumferential surface of the eccentric ring 22, for compressing gas while revolving in the compression space 24 of the cylinder 26, an upper frame 30 which is fixed on the upper side surface of the cylinder 26 so that it can be sealed, for forming a part of the compressing space 24 of the cylinder 26 and rotably supporting the rotational shaft 20 and a lower frame 32 which is fixed on the lower side surface of the cylinder 26 so that it can be sealed, and in which a high pressure chamber 34 through which gas compressed in the compressing space 24 of the cylinder 26 is temporarily stored and is discharged to the discharge tube 14.

The cylinder 26 is formed in a type of a circular disk having a predetermined thickness and is fixed on an inner circumferential surface of the case 2, a compressing space 24 for compressing gas while revolving the rolling piston 28 is formed at the center of the cylinder 26, and a suction passage 36 which communicates with the compressing space 24 in an upward direction, for flowing gas sucked through the suction tube 12 to the compressing space 24.

A vane 38 which performs a linear reciprocating movement in a radius direction of the compressing space 24 is formed on the inner circumferential surface of the cylinder 26 in order to divide the compressing space 24 into a suction region 24*a* to which gas is sucked and a compressing region 24*b* in which the sucked gas is compressed.

The vane 38 is inserted in an insertion groove 40 which is formed at a side of the cylinder 26 so that it can linearly move, and an elastic member 42 for giving an elastic force to the vane 38 so as to be contacted on the outer circumferential surface of the rolling piston 28 is installed between the insertion groove 40 and the vane 38.

It is desirable that the elastic member 42 is composed of a compressing coil spring.

The upper frame 30 is combined on the upper surface of the cylinder 26 by a plurality of bolts 44, and a through hole 46 in which the rotational shaft is rotably supported is formed at the center.

Figure 5:
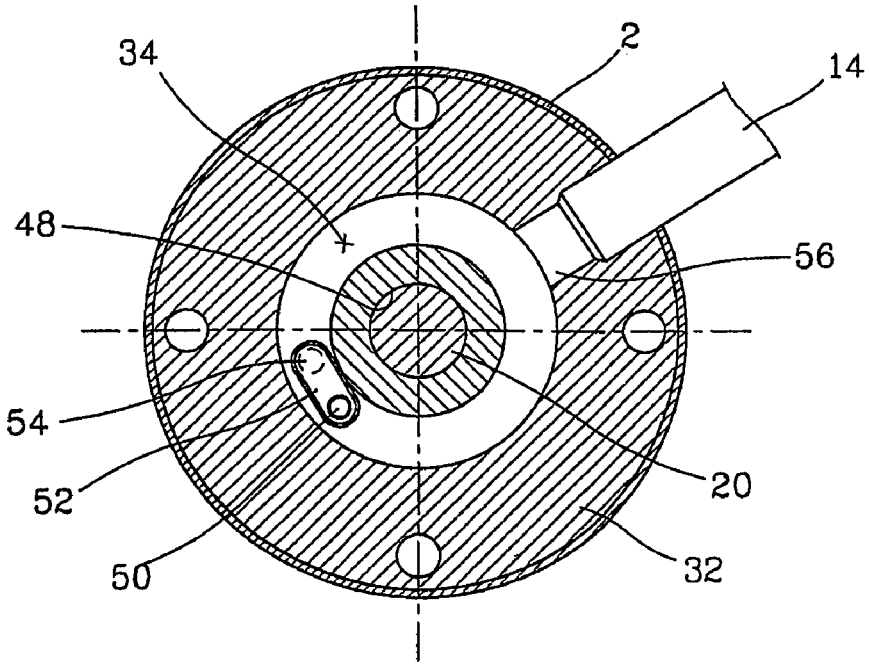
FIG. 5 is a cross-sectional view taken along section line II—II of FIG. 3.

As shown in FIG. 5, the lower frame 32 which is combined on a lower surface of the cylinder 26 so that it can be sealed includes a through hole 48 through which the rotational shaft 20 rotably passes at the center of the frame 32, a high pressure chamber 34 for reducing noise generated in gas discharge as gas compressed in the compressing space 24 of the cylinder in the circumferential direction is temporarily stored, and a discharge passage 50 for connecting the high pressure chamber 34 and the compressing space 24.

A check valve 52 for preventing gas discharged from the compressing space 24 to the high pressure chamber 34 from inversely flowing to the compressing space 24 is mounted on an upper surface of the high pressure chamber 34.

The check valve 52 is formed in a plate type having a predetermined elastic force, a side thereof is fixed on the upper surface of the high pressure chamber 34 by bolts 54 and the other side is formed to open and close the discharge passage 50.

A discharge flow path 56 for connecting between the high pressure chamber 34 and discharge tube 14 is formed on a side surface of the lower frame 32, and a sealing plate 58 for sealing the high pressure chamber 34 is mounted on the lower surface of the lower frame 32.

Figure 6:
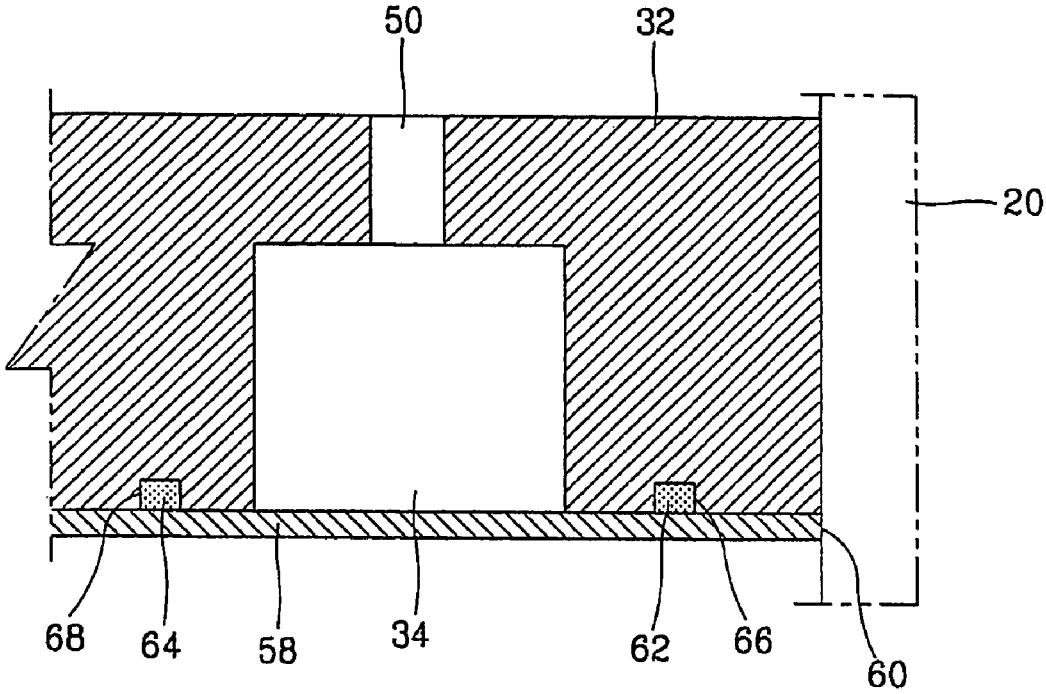
FIG. 6 is a partial cross-sectional view showing the compressing unit of the hermetic compressor of the present invention.

As shown in FIG. 6, the sealing plate 58 is formed in a shape of a circular disk having a predetermined thickness, a through hole 60 through which the rotational shaft 20 passes is formed at the center of the sealing plate 58, and sealing members 62 and 64 for preventing gas from being leaked from the high pressure chamber 34 are mounted in the inner and outer circumferential directions of the high pressure chamber 34.

The sealing members 62 and 64 include a first sealing member 62 inserted in a first groove which is formed on the lower surface of the lower frame 32 in an inner circumferential direction at a predetermined interval from the high pressure chamber 34 and a second sealing member 64 inserted in a second groove 68 which is formed on the lower surface of the lower frame 32 in an outer circumferential direction at a predetermined interval from the high pressure chamber 34.

Here, it is desired that the first and second sealing members 62 and 64 are formed with rubber materials of a ring type.

At the lower end of the rotational shaft 20, an oil supply apparatus (not shown) for supplying oil filled at a lower portion of the case 2 to a moving portion and a friction portion is installed.

The operation of the hermetic compressor in accordance with the present invention with the above structure will be described as follows.

In the hermetic compressor, the rotor 18 rotates by interaction with the stator 16 when the power is applied to the driving unit 4, and the rotational shaft 20 which is connected with the rotor 18 becomes to rotate.

Then, as the rolling piston 28 which is fixed on the eccentric ring 22 of the rotational shaft 20 revolves in the compression space 24 of the cylinder 26, it compresses gas.

Through the suction tube 12, gas is sucked into the case 2, and the gas sucked into the case 2 is flowed to the suction region 24*a* in the compression space 24 of the cylinder 26 through the suction passage 36. Here, since the suction tube 12 is installed at a lower side of the driving unit 4, the gas sucked through the suction tube 12 is sucked to the compressing space 22 of the cylinder without passing the driving unit 4.

The gas sucked to the suction region 24*a* moves to the compression region 24*b* while being compressed by revolution of the rolling piston 28, and the gas compressed in the compressing region 24*b* flows to the high pressure chamber 34 through the discharge passage 50. At this time, the check valve 52 which is installed in the discharge passage 50 prevents the gas sucked to the high pressure chamber 34 from inversely flowing to the compressing space 24.

The gas flowed to the high pressure chamber 34 is discharged to the discharge tube 14 through the discharge flow path 64.

Figure 7:
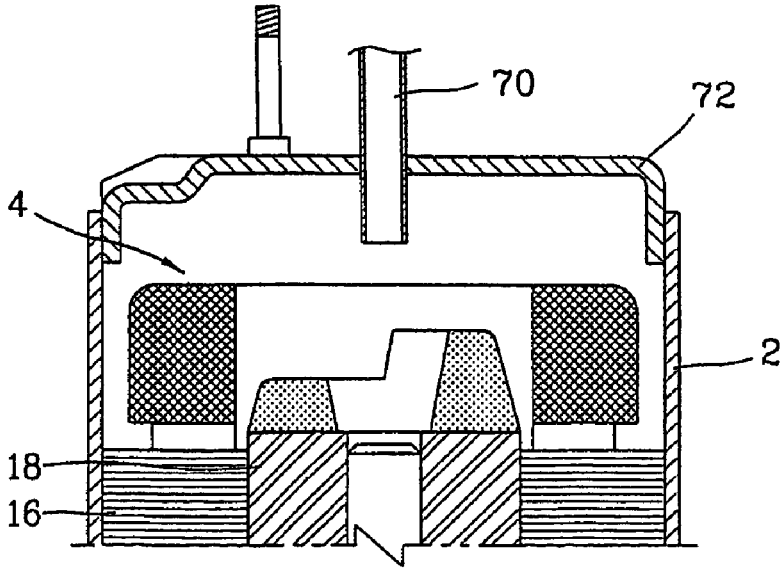
FIG. 7 is a transverse sectional view showing a hermetic compressor in accordance with the other embodiment of the present invention.

FIG. 7 is a transverse sectional view showing a hermetic compressor in accordance with the other embodiment of the present invention.

In the hermetic compressor in accordance with another embodiment, the suction tube 70 through which gas is sucked is connected with the upper cover 72 which is mounted at the upper portion of the case 2, and the structure of the rest parts is same as the above described structure of the embodiment of the present invention.

That is, since the suction tube 70 is connected to the upper cover 72 which is fixed to the upper portion of the case 2, the gas which flows into the case 2 passes the driving unit 4 and is sucked to the compressing unit 6.

The hermetic compressor in accordance with another embodiment can improve efficiency of the compressor by cooling the rotor 16 and stator 18 of the driving unit as low temperature and low pressure gas passes the driving unit 4.

In case the hermetic compressor in accordance with another embodiment is applied to a cooling cycle, low temperature and low pressure refrigerant gas which passed an evaporator flows into the case through the suction tube, is compressed while passing through the compressing unit and is discharged to the discharge tube. Accordingly, the refrigerant under the condition of non-aerified liquid is aerified in the evaporator while passing through the inside of the case, and inflow of non-aerified refrigerant gas into the compressing unit can be prevented, thus to exclude usage of an accumulator which has been used to prevent inflow of liquid refrigerant.

INDUSTRIAL APPLICABILITY

As so far described, according to the hermetic compressor which is composed and operated, since the low temperature and low pressure gas sucked to the suction tube is compressed while flowing into the case and passing the compressing unit and then discharged to the discharge tube, low pressure is formed inside the case and accordingly, it is not necessary to reinforce a strength and to increase the thickness of the case, thus to reduce the manufacturing cost.

Also, the efficiency of the driving unit can be increased by reducing temperature of the driving unit as the low temperature and low pressure gas passes between the rotor and stator of the driving unit by connecting the suction tube with the upper portion of the case.

Also, since the compressed gas is directly discharged to the discharge tube without passing the inside of the case, vibration according to compressing pulsation generated inside the case can be reduced.

The invention claimed is:

1. A hermetic compressor, comprising:

a case having a hermetic space and being connected with a suction tube which sucks gas with low temperature and pressure to the hermetic space and a discharge tube which discharges the compressed gas outside;

a driving unit mounted at an upper portion of the case, for generating a driving force; and a compressing unit mounted at a lower portion of the case and connected to the driving unit by a rotational shaft so as to compress the gas with low temperature and low pressure sucked into the case through the suction tube by a rotational force generated from the driving unit and discharge the gas through the discharge tube, the compression unit including:

an eccentric ring which is fixed at a lower portion of the rotational shaft;

a cylinder in which the eccentric ring is rotably arranged, a compression space where gas is compressed is formed, a suction passage for guiding gas sucked into the case to the compression space is formed at a side of the compression space; and a lower frame which is fixed on the lower side surface of the cylinder so that it can be sealed, and in which a high pressure chamber through which gas compressed in the compressing space of the cylinder is temporarily stored and is discharged to the discharge tube, the high pressure chamber being distinct from the compression space and the discharge tube.

2. The compressor of claim 1, wherein the compressing unit includes:

a rolling piston which is fixed on the outer circumferential surface of the eccentric ring, for compressing gas while revolving in the compression space of the cylinder; and an upper frame which is fixed on the upper side surface of the cylinder so that it can be sealed, for rotably supporting the rotational shaft.

3. The compressor of claim 1, wherein the suction tube is positioned at an upper portion of the compressing unit, and the discharge tube is positioned on a side surface of the compressing unit.

4. The compressor of claim 1, wherein the suction tube is connected with an upper cover which is fixed at the upper side of the case so that the gas sucked into the case passes the driving unit and is supplied to the suction unit.

5. The compressor of claim 2, wherein the cylinder is formed in a type of a circular disk having a predetermined thickness and is fixed on an inner circumferential surface of the case, a compressing space for compressing gas while revolving the rolling piston is formed at the center of the cylinder, and a suction passage which communicates with the compressing space in an upward direction, for flowing gas sucked through the suction tube to the compressing space.

6. The compressor of claim 2, wherein a vane which performs a linear reciprocating movement in a radius direction of the compressing space in order to divide the compressing space into a suction region to which gas is sucked and a compressing region in which the sucked gas is compressed is installed on an inner circumferential surface of the cylinder.

7. The compressor of claim 2, wherein the lower frame which is combined on a lower surface of the cylinder so that it can be sealed includes a through hole through which the rotational shaft rotably passes at the center of the frame, a high pressure chamber for reducing noise generated in gas discharged while gas compressed in the compressing space of the cylinder in the circumferential direction is temporarily stored and discharged, and a discharge passage for connecting the high pressure chamber and compressing space.

8. A hermetic compressor, comprising:

a case having a hermetic space and being connected with a suction tube which sucks gas with low temperature and pressure to the hermetic space and a discharge tube which discharges the compressed gas outside;

a driving unit mounted at an upper portion of the case, for generating a driving force; and a compressing unit mounted at a lower portion of the case and connected to the driving unit by a rotational shaft so as to compress the gas with low temperature and low pressure sucked into the case through the suction tube by a rotational force generated from the driving unit and discharge the gas through the discharge tube, the compressing unit including:

an eccentric ring which is fixed at a lower portion of the rotational shaft;

a cylinder in which the eccentric ring is rotably arranged, a compression space where gas is compressed is formed, a suction passage for guiding gas sucked into the case to the compression space is formed at a side of the compression space;

a rolling piston which is fixed on the outer circumferential surface of the eccentric ring, for compressing gas while revolving in the compression space of the cylinder;

an upper frame which is fixed on the upper side surface of the cylinder so that it can be sealed, for rotably supporting the rotational shaft; and a lower frame which is fixed on the lower side surface of the cylinder so that it can be sealed, and in which a high pressure chamber through which gas compressed in the compressing space of the cylinder is temporarily stored and is discharged to the discharge tube, wherein the lower frame which is combined on a lower surface of the cylinder so that it can be sealed includes a through hole through which the rotational shaft rotably passes at the center of the frame, a high pressure chamber for reducing noise generated in gas discharged while gas compressed in the compressing space of the cylinder in the circumferential direction is temporarily stored and discharged, and a discharge passage for connecting the high pressure chamber and the high pressure chamber being distinct from the compression space and the discharge tube, wherein a check valve for preventing gas discharged from the compressing chamber to the high pressure chamber from being inversely flowed to the compressing chamber is mounted in the discharge passage of the lower frame.

9. The compressor of claim 8, wherein a side of the check valve is fixed on an upper surface of the high pressure chamber and the other side is formed in a plate type having a predetermined elastic force to open and close the discharge passage.

10. A hermetic compressor, comprising:

a case having a hermetic space and being connected with a suction tube which sucks gas with low temperature and pressure to the hermetic space and a discharge tube which discharges the compressed gas outside;

a driving unit mounted at an upper portion of the case, for generating a driving force; and a compressing unit mounted at a lower portion of the case and connected to the driving unit by a rotational shaft so as to compress the gas with low temperature and low pressure sucked into the case through the suction tube by a rotational force generated from the driving unit and discharge the gas through the discharge tube, the compressing unit including:

an eccentric ring which is fixed at a lower portion of the rotational shaft;

a cylinder in which the eccentric ring is rotably arranged, a compression space where gas is compressed is formed, a suction passage for guiding gas sucked into the case to the compression space is formed at a side of the compression space;

a rolling piston which is fixed on the outer circumferential surface of the eccentric ring, for compressing gas while revolving in the compression space of the cylinder;

an upper frame which is fixed on the upper side surface of the cylinder so that it can be sealed, for rotably supporting the rotational shaft; and a lower frame which is fixed on the lower side surface of the cylinder so that it can be sealed, and in which a high pressure chamber through which gas compressed in the compressing space of the cylinder is temporarily stored and is discharged to the discharge tube, wherein the lower frame which is combined on a lower surface of the cylinder so that it can be sealed includes a through hole through which the rotational shaft rotably passes at the center of the frame, a high pressure chamber for reducing noise generated in gas discharged while gas compressed in the compressing space of the cylinder in the circumferential direction is temporarily stored and discharged, and a discharge passage for connecting the high pressure chamber and the high pressure chamber being distinct from the compression space and the discharge tube, wherein a sealing plate for sealing the high pressure chamber is mounted on the lower surface of the lower frame.

11. The compressor of claim 10, wherein the sealing plate is formed in a shape of a circular disk having a predetermined thickness, a through hole through which the rotational shaft passes is formed at the center of the sealing plate, and a sealing member for preventing gas from being leaked from the high pressure chamber is mounted in the inner and outer circumferential directions of the high pressure chamber.

12. The compressor of claim 11, wherein the sealing member includes: a first sealing member inserted in a first groove which is formed in an inner circumferential direction of the high pressure chamber at a predetermined interval from the high pressure chamber; and a second sealing member inserted in a second groove which is formed in an outer circumferential direction of the high pressure chamber at a predetermined interval from the high pressure chamber.

13. The compressor of claim 12, wherein the first and second sealing members are formed with rubber materials of a ring type.

* * * * *